United States Patent [19]

Vandeweghe et al.

[11] Patent Number: 4,653,544

[45] Date of Patent: Mar. 31, 1987

[54] WEFT CANCELLATION MECHANISM FOR GRIPPER LOOMS

[75] Inventors: Michel Vandeweghe, Heuvelland; Frans Vandenabeele, Zonnebeke, both of Belgium

[73] Assignee: N. V. Weefautomaten Picanol, Y pres, Belgium

[21] Appl. No.: 717,693

[22] Filed: Mar. 29, 1985

[30] Foreign Application Priority Data

Apr. 6, 1984 [BE] Belgium ..... 2/60387

[51] Int. Cl.[4] ..... D03D 47/34

[52] U.S. Cl. ..... 139/116; 139/450

[58] Field of Search ..... 139/1, 116, 429, 450, 139/453

[56] References Cited

U.S. PATENT DOCUMENTS

| | | | |
|---|---|---|---|
| 3,237,651 | 3/1966 | Ancet et al. | 139/453 |
| 3,705,607 | 12/1972 | Tollison et al. | 139/116 |
| 4,398,568 | 8/1983 | Rydborn | 139/116 |

FOREIGN PATENT DOCUMENTS

| | | | |
|---|---|---|---|
| 2935507 | 3/1981 | Fed. Rep. of Germany | 139/450 |
| 246140 | 2/1926 | Italy | 139/450 |

*Primary Examiner*—Henry S. Jaudon

*Attorney, Agent, or Firm*—Bacon & Thomas

[57] ABSTRACT

A weft cancellation mechanism for gripper looms, characterized by consisting primarily of a bar (7) located in a position situated between the feed of the weft (4) and the shed (2) which forms an angle with the weft or wefts (4), this bar (7) being attached to an electromagnet (9) which, once a weft breaks, is activated so as to remove the weft (4) offered up to the gripper from the path of the gripper (6).

5 Claims, 2 Drawing Figures

Figure 1:
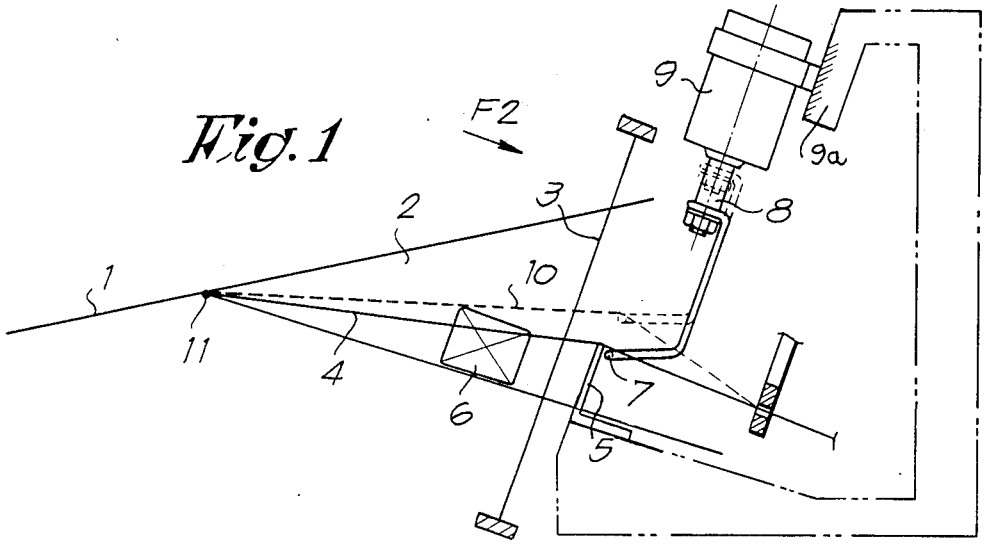

F2
1
2
3
4
5
6
7
8
9
9a
10
11

S
W
1
2
3
4
6
7
8
9
10
11

WEFT CANCELLATION MECHANISM FOR GRIPPER LOOMS

This invention concerns a weft cancellation mechanism for gripper looms, i.e. a mechanism which enables the weft being held ready for the gripper to be cancelled or removed from the path of the gripper if the weft should break.

It is well-known that during weaving it is extremely important both to limit stoppages of the machine to the shortest possible time, for example when the weft breaks, and also to take the necessary measures to reduce the risk of faulty weaving to a minimum.

Therefore this invention concerns a mechanism which enables the weaving of a specific fault to be prevented and thus consequently also avoids the stoppage of the machine which would have been necessary to remove such a fault.

Thus this invention concerns a mechanism which enables the weft which has been offered up to the gripper to be automatically cancelled in the event of a weft break and thus automaticaly free the broken weft, irrespective of the moment at which the machine is stopped.

It is indeed a fact that it is difficult, if not impossible, to stop fast running weaving looms at a particular shot. In other words, the broken weft is always woven in and the following weft has already been offered up to the gripper and carried by it through part of the shed before the machine has actually come to a standstill.

In order to enable the removal of the broken weft to be carried out automatically, it is imperative that the following weft which has already been carried through the shed has been removed from the shed before the gripper passes back through it. Thus it is clear that it is more efficient to ensure that the following weft is prevented from being drawn through at all, which is the objective of the present invention.

The weft cancellation mechanism for gripper looms as described by the invention which shows the following and other advantages consists to this effect primarily of a bar 7 which forms an angle with the weft or wefts 4 located in a position situated between the feed or supply of the weft 4 and the shed 2, this bar 7 being attached to an electromagnet 9 which, once a weft breaks, is activated so as to remove the weft 4 offered up to the gripper from the path of the gripper 6.

Figure 2:
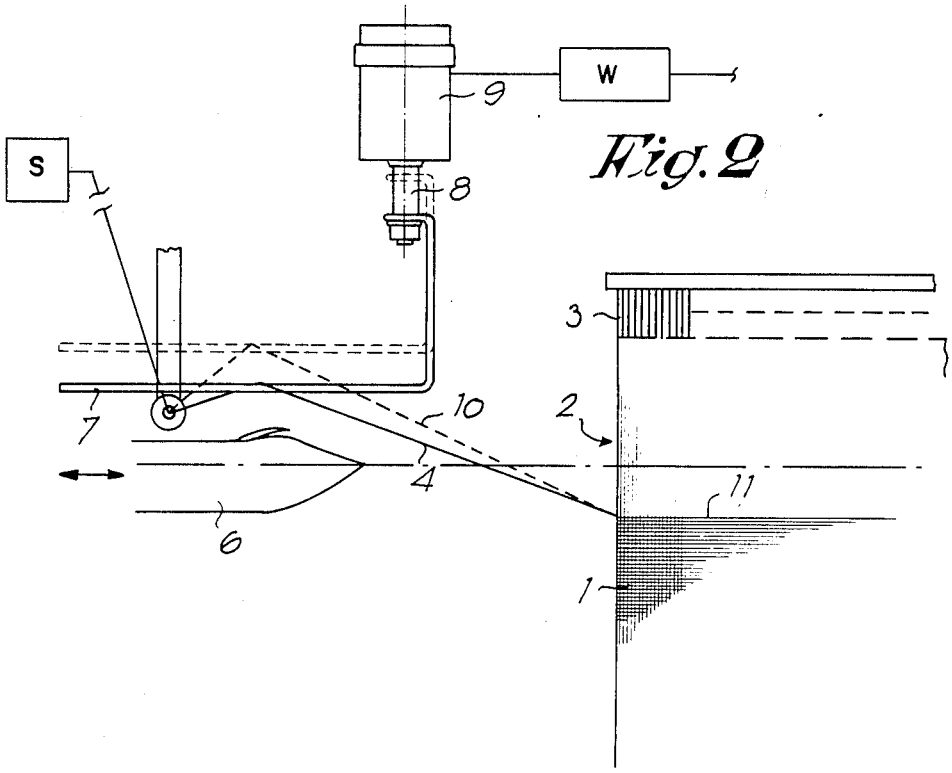

With a view to better illustrating the characteristics of the invention, and as an example which is not in any way whatsoever limiting, the following schematic presentation of a mechanism as described by the invention is given with reference to the accompanying sketches, in which:

FIG. 1 shows a side view of the mechanism as described by the invention in its relative position with regard to the shed of the loom; and FIG. 2 shows a view from the direction of arrow F2 in FIG. 1.

In these figures, the actual fabric 1 is shown with respect to the shed 2 and the reed 3, where the normal weft 4 is led over a so-called thread support 5 in such a manner that this weft 4 is placed into the path of the gripper 6, and all this is carried out in such a manner that this latter can grip the weft 4 thus offered up and carry it into the shed 2.

The invention envisages that between the position where the weft 4 is fed in from supply 5 and the thread support 5, an elongated bar 7 extending parallel to the reed 3 in the weftwise direction across the shed 2 should be located, one end of which is attached to the core 8 of a normally extended (solid lines in FIG. 1) lifting magnet 9 which is attached to the machine frame 9*a*. *The bar 7 thus is located normally below and adjacent the normal path of movement of weft 4 as it approaches the gripper 6.*

The objective of this mechanism is that whenever the breakage of a weft 4 is detected in a well-known manner for example by a weft break detector and signal means "w", this detection results in the activation and retraction of the lifting magnet 9, through which the latter and thus the bar 7, as shown in the figures by dotted lines, are moved perpendicular to the direction of travel of the gripper 6 (transversely of the longitudinal axis of bar 7) such that the weft 4 is placed into position 10, with the effect that this weft is positioned at such a height that it cannot be picked up by the gripper 6. A weft break detector system can be seen in German patent specification No. 29 35 507 published Mar. 19, 1981.

The introduction of a weft at the moment when a weft breakage is detected is thus rendered impossible, so that the removal of the broken weft or shot is substantially simplified and the stoppage of the machine is thus kept as short as possible.

As illustrated in the figures, the bar 7 is positioned parallel with the reed 3 and beaten-up edge or fell 11 and the vertical movement of the bar 7 adjacent the shed in the weft feed area is in a perpendicular direction to the path of the gripper 6. Bar 7 is located below the weft, as illustrated.

However, there is nothing to prevent this bar 7 and/or the lifting magnet 9 from being set up in another manner.

It would also be potentially possible to make the bar 7 function as the thread support 5, in which case the thread support 5 would no longer be required.

Finally, it should be observed that although only one weft is illustrated in FIGS. 1 and 2, in most cases the bar 7 will be common for various types of weft which may differ from each other in terms of colour, composition or suchlike.

The present invention is thus in no way whatsoever limited to the scehmatic application given here by way of an example of a weft cancellation mechanism, but this latter may be constructed in all types of shapes and dimensions without falling ouside the scope of the invention.

What is claimed is:

1. In a weft cancellation mechanism for a gripper loom, the loom including a weft feed area, a fell, a shed, a reed, a weft feed system including a weft supply and a weft gripper movable through the shed parallel to the reed arranged to normally engage a weft yarn in the weft feed area, and means for generating a broken weft signal, the improvement comprising, said weft cancellation mechanism comprising a movable elongated bar located between the weft supply and the fell extending lengthwise parallel to the plane of the reed, said bar disposed normally at an angle relative to the direction of weft feed to the gripper and adjacent and beneath the normal path of movement of weft yarn and means controlled by a broken weft signal to move the bar transversely of its longitudinal axis whereat at least one weft yarn is engaged by the bar and moved out of the path of the gripper.

2. The improvement in a weft cancellation mechanism as claimed in claim 1, wherein the direction of movement of the bar is perpendicular to the direction of gripper movement.

3. The improvement in a weft cancellation mechanism as claimed in claim 2, wherein the means for moving the bar comprises a solenoid having a movable element directly engaging the bar.

4. The improvement in a weft cancellation mechanism as claimed in claim 3, wherein the bar extends lengthwise under the path of travel of the weft yarn as the weft yarn approaches the gripper.

5. The improvement in a weft cancellation mechanism as claimed in claim 4 wherein the bar is located in advance of the position where the weft yarn is engaged by the gripper.

* * * * *